US006112386A

United States Patent [19]

Weinsdörfer et al.

[11] Patent Number: 6,112,386

[45] Date of Patent: Sep. 5, 2000

[54] INTERLACING APPARATUS AND PROCESS FOR FILAMENT INTERLACING

[75] Inventors: Helmut Weinsdörfer; Ulrich Weinsdörfer, both of Pliezhausen, Germany

[73] Assignee: Deutsche Institute fur Textil-und Faserforschung, Stuttgart Denkendorf, Germany

[21] Appl. No.: 09/169,096

[22] Filed: Oct. 9, 1998

[30] Foreign Application Priority Data

Oct. 13, 1997 [DE] Germany ..... 197 45 182

[51] Int. Cl.[7] ..... D02J 1/08

[52] U.S. Cl. ..... 28/274; 28/271

[58] Field of Search ..... 28/271, 272, 273, 28/274, 275, 276, 283; 57/333, 350, 908

[56] References Cited

U.S. PATENT DOCUMENTS

| | | | |
|---|---|---|---|
| 3,262,179 | 7/1966 | Sparling | 28/274 |
| 3,571,868 | 3/1971 | Buzano | 28/275 |
| 3,730,413 | 5/1973 | McDermott et al. | 28/275 |
| 3,751,775 | 8/1973 | Psaras | 28/274 |
| 3,895,420 | 7/1975 | Strutz et al. . | |
| 4,251,904 | 2/1981 | Sano et al. | 28/274 |
| 4,355,445 | 10/1982 | Matsumoto et al. | 28/274 |
| 4,417,375 | 11/1983 | Sano et al. . | |
| 4,639,986 | 2/1987 | Borenstein | 28/274 |
| 4,965,916 | 10/1990 | Artunc et al. . | |
| 5,481,787 | 1/1996 | Sano et al. | 28/271 |

FOREIGN PATENT DOCUMENTS

| | | |
|---|---|---|
| 4113927A1 | 11/1992 | Germany . |
| 415939 | 1/1967 | Switzerland . |

OTHER PUBLICATIONS

German Patent Office Search Report, Apr. 20, 1998.

*Primary Examiner*—Amy B. Vanatta
*Attorney, Agent, or Firm*—Dority & Manning

[57] ABSTRACT

An apparatus for interlacing a multifilament yarn includes a housing with a conduit defined therethrough. A jet nozzle is configured with the housing. The jet nozzle includes a main channel symmetric to the yarn conduit axis and at least two side channels. The main channel directs a greater volume of pressurized air into a central region of the yarn conduit as compared to the side channels that direct a lesser volume of pressurized air to peripheral zones where substantially no interlacing of the yarn takes place.

27 Claims, 4 Drawing Sheets

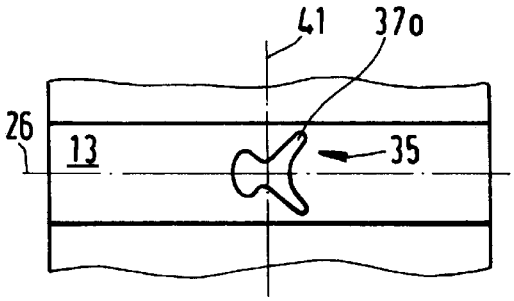
FIG. 20
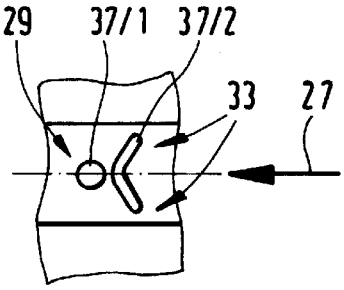
FIG. 21
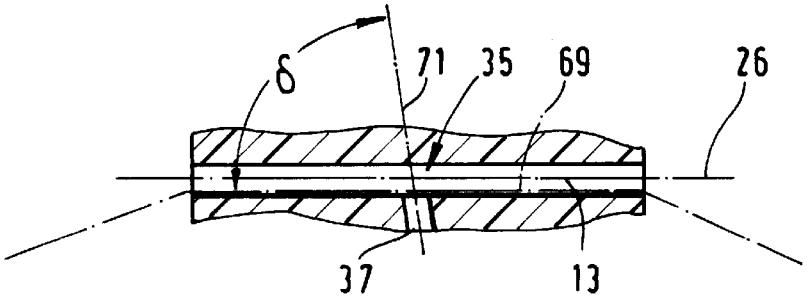
FIG. 22
FIG. 23
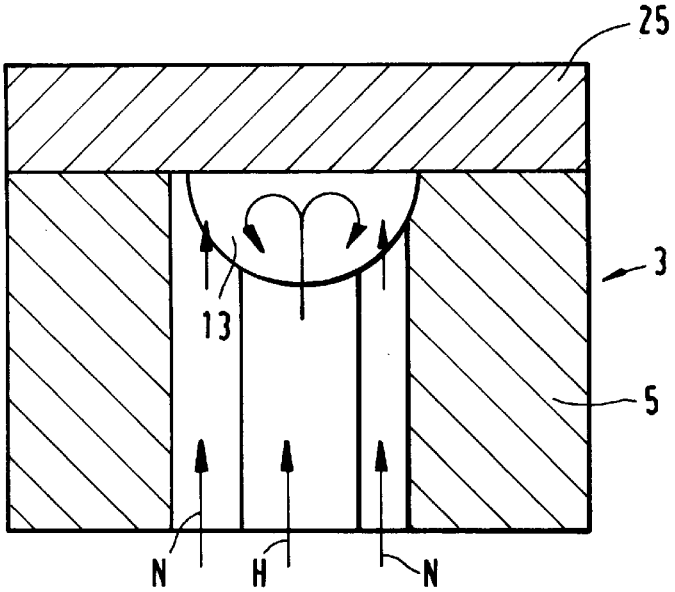

INTERLACING APPARATUS AND PROCESS FOR FILAMENT INTERLACING

BACKGROUND OF THE INVENTION

The present invention concerns an interlacing apparatus and process for the interlacing of multifilament yarns in accord with the generic concept of using a flow of a medium through a specially designed jet nozzle to entwine multifilament yarns.

Interlacing apparatuses and processes of the kind discussed here, have been brought into common knowledge by DE 37 11 759 C2. The apparatus and process serve to improve the integrity of the filaments of the multifilament yarns and thereby better their further workability. The reason for this is that the single multifilament yarn, which is comprised of substances which are preferably thermoplastic or other material, upon being fed to the interlacing apparatus is yet untwisted or possesses only a minimum protective twist, which still has insufficient integrity for further processing. The required integral strength is obtained by the multifilament yarn only by the interlacing of its filaments. By means of the interlacing apparatus, the filaments of several multifilament yarns can be commonly intertwined into one unified multifilament yarn.

The interlacing quality, or the outcome of the interlacing, is characterized by certain points. The plaiting/interlacing tendencies of the filaments and also the spacing lying between the said intertwined filaments define these points. Within these points, the possibility exists for essentially non-entwined or open places in the yarn. When an interlacing of the multifilament yarn occurs, in addition a very weak interlacing can be achieved, in which no interlacing points arise. In this situation, only a light, scarcely visible commingling of the filaments takes place. Such yarns exhibit only a small degree of thread closure and without additional expensive measures, cannot be subjected to further processes such as imparting twist, spindle whorling or finishing. At the most, these yarns can only be further worked under certain limiting conditions.

"Thread closure" is a customary designation for the compactness of multifilament yarns and describes the integrity, i.e. the cohesiveness of the filaments.

The known interlacing apparatus possesses a yarn conduit through which a multifilament yarn passes which has a plurality of filaments. As this takes place, the filaments are commingled by means of an air flow issuing from a jet nozzle opening. The jet nozzle exhibits normally a circular or elliptically shaped cross-section, which is designed symmetrically to the longitudinal axis of the yarn conduit. In many cases, the commingling of the filaments of the multifilament yarn from this apparatus does not result in a desirable degree of interlacing. The multifilament yarn exhibits irregularities, for example lengthy, faulty stretches, which indicate unentwined yarn portions. Further processing of the multifilament yarn, for instance weaving, tufting, knitting, or sewing, leads to damage to these open, unprotected yarn stretches. Single filaments break and open out, whereby a thread breakage or break in neighboring threads and/or faults in textile surface formation occurs.

OBJECTS AND SUMMARY OF THE INVENTION

It is therefore a principal object of the present invention to avoid these disadvantages of the technology and to create an interlacing apparatus and a process, which will improve the quality of the entwined yarn, and which will enhance the process of comparing the node periods and the open yarn places. Furthermore, the interlacing apparatus should be simple in construction and operate economically in regard to the consumption of air. Additional objects and advantages of the invention will be set forth in part in the following description, or may be obvious from the description, or may be learned through practice of the invention.

By means of DE 28 13 368 C2, it is indeed already known that vortex jets can be used to employ a main flow and at the same time a pulsating adjoining flow, which are caused to flow counter-currently or at right angles to one another in the yarn conduit in order to influence each other therein. This process has, however, not achieved the result expected of it and consequently has not been accepted in practice.

Further, DE 41 13 927 has made known the introduction of a main air flow into the yarn conduit by means of a jet nozzle, the cross-section of the opening of which is designed generally symmetrical to the longitudinal axis of the yarn conduit. Further, paired side flows are provided, whereby one side flow enters into the outer peripheral zone and the other side flow enters into another peripheral zone of the yarn conduit. Even in this case, the side flows are introduced into the principal flow on opposite sides of the yarn conduit. This type of construction is expensive because an air feed for the side flows requires a removable cover. Beyond this, it has been surprisingly revealed that the air flows do not flow as described in accord with the proposed purpose of DE 41 13 927. The main and side flows run in the same direction and do not, as called for by the current state of the technology, flow in opposition to one another. Obviously, this brings about a disturbance of the main air flow, which leads to increased air consumption and poor interlacing results.

CH-PS 415 939 makes known a provision for the medium feed inlet to have a circular cross-section or any other appropriate shape, such as rectangular, oval or the like.

In the present invention, the emphasis is on a jet nozzle opening, the shape of which is designed so that the medium, in particular, compressed air, flows in the more central zone of the yarn conduit, and paired side flows are injected into the peripheral zones thereof. A teaching of this principle is not to be inferred from any suggestion of CH-PS 415 939.

In the apparatus according to the present invention, the main and side flows are caused to flow in essentially the same direction, the main flow in the central region acts more intensively on the yarn. This main flow, entering the yarn conduit, divides into two, generally equally strong partial flow vortices, which actuate the interlacing of the filaments. The incoming side flows, which always enter the yarn conduit in a peripheral zone, because of the common direction of flow, surprisingly support the flow vortexing and assure that the filaments remain a minimum time in the said peripheral zones (dead zones).

In these peripheral zones, practically no interlacing can occur, but consistently said filaments are displaced by the side flows into the principal air flow. In this way, the number of the unentwined, open yarn places is lessened and the length of the these faulty sections is shortened. By this advantageous interactivity of the main flow and the side flows, the costs of the interlacing can be reduced, while at the same time maintaining advantageous, uniform and satisfactory results in entwining from the given consumption of the medium. Further an increase of both the rate of production and the running speed of the filaments is brought about. As a result, economy of the interlacing apparatus is achieved along with a satisfactory quality of the interlacing.

In regard to "dividing" the main medium flow, it is to be understood that the main flow and the side flows need not be physically divided. The division into main and side flows can also be effected by the shaping of the cross-section of the jet nozzles. By coordinating the main flow and the side flows in such a manner that the main flow, when compared to either of the side flows, always carries the greatest volume flow of the medium, the above described action of the interlacing is strengthened, since side flows which are too strong can lead to impairment of the main flow.

In accord with another embodiment, the cross-section of the opening of the side flow is separated from the cross-section of the main flow. The flow of the medium is thus apportioned into several separate partial flows, which, at least upon point of entry into the yarn conduit, exhibit this separateness, one from the other. In other words, the jet nozzle arrangement possesses, according to the first embodiment variant, principally one jet nozzle, and in accord with the second embodiment variant, exhibits at least two jet nozzles. These two jet nozzles (as a minimum) activate the physical separation of the partial flows of the medium.

In a preferred embodiment example of an interlacing apparatus, the cross-section of the opening of a jet nozzle is constructed from one jet nozzle. In this case, it is simple to design both the cross-section of the opening and the inlet of the medium feed (preferably compressed air) which feed the jet nozzle must handle under pressure.

However, it can be required, that the cross-section of the opening be designed from several, preferably two or three, jet nozzles. Respectively, separate flows of the medium flow issue from these nozzles. Thereby, a greater flexibility and independence is given

- to the relationship of the main flow and the side flows to one another;
- to their direction of injection, into the central zone as well as into the peripheral areas of the yarn conduit; and
- to consideration of different injection air pressures.

In addition, an embodiment of the interlacing apparatus is favored, which is comprised of a main flow seen in the running direction of the filaments which follows the side flows. The side flows injected into the outer periphery area pick up the filaments passing through the yarn conduit in that area and carry these to the central zone of the yarn conduit in which the filaments subsequently are entwined by the main flow. In this manner, thick and long interlacing points, that is nodes, are formed, which exhibit a high degree of uniformity. If, contrarily, the main flow is placed ahead of the side flows as seen in the running direction of the filaments, experience has shown that in general shorter and thinner interlacing points are formed, wherein simultaneously a higher interlacing frequency is attained. This results from the average length of the interlacing points and the average width of the interstitial space between filaments and provides the number of the interlacing points per meter.

Except by the multifilament yarn itself, the interlacing frequency is additionally influenced by:

- the thread speed upon interlacing;
- the adjusted thread tension; and
- the fineness and structure of the filaments, which can be smooth or crinkled.

Further advantageous embodiments of the apparatus are derived from the remaining subordinate claims.

The purpose of the invention will also be achieved by a process, which in the present invention includes. Because of the fact that the medium flow is divided into a main flow and into a pair of side flows, which all are moving generally in one direction, the main flow is actively reinforced in the central zone of the filament conduit while the side flows in the two peripheral zones prevent an excessive dwell time in these zones, which are ineffective for interlacing. Very strong interlacing points are produced and faulty places are avoided. By means of the coactivity of the main flow and the side flows, a high entwining quality with a minimum medium consumption is achieved.

In the following, the invention is examined more closely with the aid of the drawings.

BRIEF DESCRIPTION OF THE DRAWINGS

FIGS. 20 to 21 respectively, a plane view of a cross-section of the opening of a further embodiment variant of the jet nozzle arrangement with two main flows;

FIG. 22 a sectional view of the yarn conduit; and

FIG. 23 a schematic cross-section of the interlacing apparatus.

DETAILED DESCRIPTION

Figure 1:
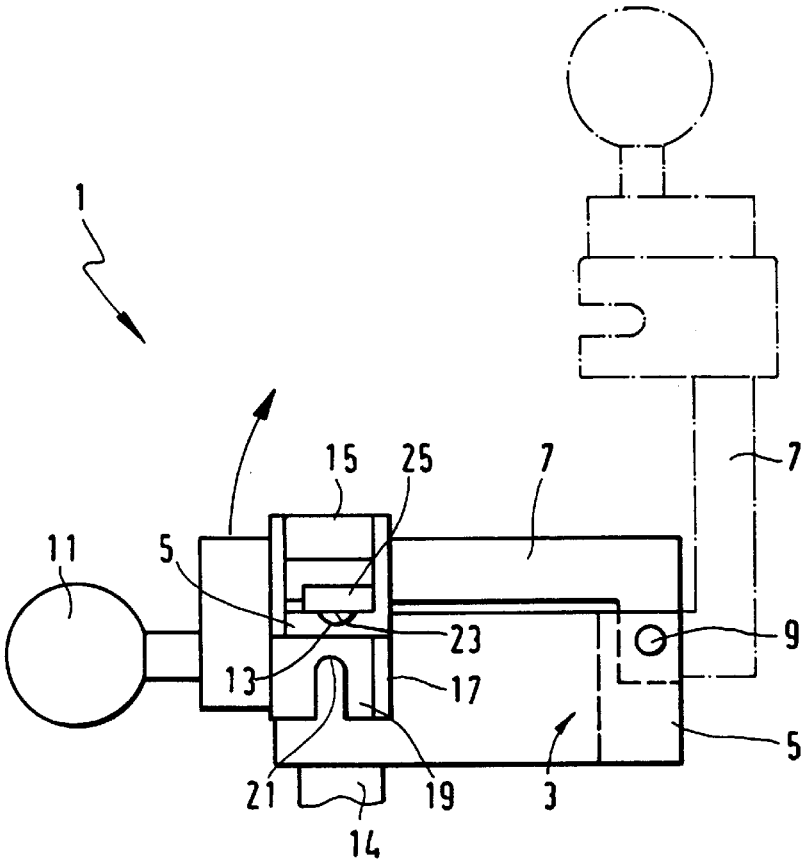
FIG. 1 a side view of an embodiment of an interlacing apparatus.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

The interlacing apparatus described in the following can be universally installed for the entwining of multifilament yarns. Smooth as well as crinkled multifilament yarns, are to be understood as being considered in connection with the present invention. The crinkled multifilament yarns are produced, for instance, by imitation twist, stuffing box crimping, or edge drawing. The multifilament yarn is comprised of a number of filaments, which advantageously consist of thermoplastic plastics, for instance, polyamides, polyester, polypropylene, polyethylene. However, viscose, glass, Kevlar®, carbon or other high modular fibers are also included. With the aid of the interlacing apparatus, it is also possible to entwine the filaments of several individual multifilament yarns commonly into one multifilament yarn. Further, special effect yarns can be produced, such as mixtures of multifilament yarns with fiber yarns or elastic yarns.

The interlacing apparatus can, for instance, be installed on texturing machines, as well as other machines or equipment, machines for spinning, stretching, or bobbin winding. The multifilament yarns entwined on the interlacing apparatus are further processed on machines for weaving, knitting, tufting, and similar textile machines. This further processing is without the necessity of a compulsory subsequent treatment of the multifilament yarn, such as sequential winding, interlacing, smoothing or the like for the production of the required thread closure.

FIG. 1 shows a schematic profile view of an embodiment of an interlacing apparatus 1 that includes a housing 3 of which the latter possesses several, here a total of two, housing parts 5 and 25. The second housing part 25 is pivotable by means of a swinging arm 7 on a hinge 9, linked to the first housing part 5, forming thereby a cover. By means of a hand grip 11 affixed to the second housing part 25, this second housing part 25 is pivotable upward out of its closed position, which is designated with solid lines, into an open position represented in FIG. 1 by dotted lines.

The interlacing apparatus 1 includes moreover, a yarn conduit 13 which penetrates the housing 3, which, as said, is comprised of the components 5 and 25. When the second housing component 25 is placed in its closed position, then the yarn conduit 13 is circumferentially closed with the exception of the cross-section of the opening of a (not shown) jet nozzle arrangement. Under these conditions, only on the entry and exit openings of the yarn conduit 13 is the said conduit open.

In order to introduce a (not shown in FIG. 1) multifilament yarn into the yarn conduit 13 or to be able to take the same out without cutting it, then the second housing part 25 is swung up, so that the yarn conduit, throughout its entire length is exposed. The jet nozzle arrangement is connected by means of a feed piping line 14 with a source of the medium, from which source the jet nozzle is supplied with a compressed medium, preferably air. The multifilament yarn is subjected to a flow of said medium, that entwines its filaments together, upon the yarn running through the straight yarn conduit 13. A more detailed description of this is provided later.

A U-shaped yoke 15 is affixed onto the second housing part 25 to serve as a rigid carrier. Installed on each of the bowed arms thereof, of which only the arm 17 is visible in FIG. 1, is a yarn guide 19. As viewed in a vertical direction, the two guides 19 are formed by inverted U-shaped members that open downward, which possess on the upper sides of their interior spaces guiding surfaces 21 for directional change of the multifilament yarn.

In this embodiment example, the yarn conduit 13 is machined into the first housing part 5 in the shape of a channel/groove, which exhibits along its entire length a uniform, semicircular, open cross-section. The top 23 of the yarn conduit 13 is constructed from the flat underside of the second housing part 25, which said part is affixed to the pivoting arm 7. The cross-sectional shape of the yarn conduit 13 can, of course, be designed in a different manner.

Figure 2:
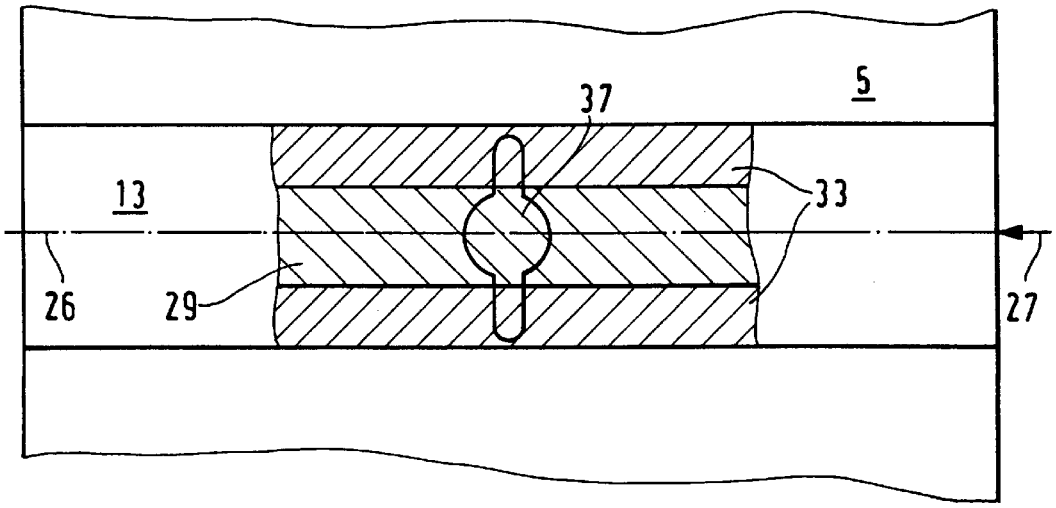
FIG. 2 a schematic plane view of a yarn conduit.

FIG. 2 schematically shows a plane view of the first housing part 5 of the interlacing apparatus 1, in which the yarn conduit is machined in. Figuring from the longitudinal central axis 26, as seen at right angles to the running direction of the filaments (arrow 27), this view is subdivided into two figurative, cross-hatched depicted zones, namely, divided into a middle zone 29, and an outer peripheral zone 33. The outer peripheral zone 33 lies between the interior sides of the yarn conduit 13 and the middle zone 29. The peripheral zone 33 is looked upon as a "dead zone".

In order to achieve a desired degree of interlacing, the cross-section of the opening 37 of the jet nozzle arrangement presented in FIG. 2 is so designed that the medium flow is separated into one main flow and two side flows. The main flow H passes in the central zone 29 and divides itself by impact against the underside of the housing part, i.e. the top 25, into two partial flow vortices with different directions of turning (FIG. 23). These vortices activate the desired localized interlacing/twisting of the filaments of the multifilament yarn. The produced filament interlacing can show different local patterns, for instance, braided or plaited patterns. The two side flows, N, which contribute basically nothing to the interlacing of the filaments, flow each in the peripheral zone 33 and lead the filaments which have migrated into the said peripheral zone back into the middle zone 29 of the yarn conduit 13, where these are again seized by the main flow H and are thereby entwined. In this way, the duration of the travel of the filaments in the peripheral zone 33 through the yarn conduit 13 is minimized, so that unentwined, open yarn places are avoided or at least reduced in number. Through the interlacing of the filaments by the medium flow, a structuring of the multifilament yarn comes about that optically changes the multifilament yarn. By the apportionment of the medium flow into several partial flows, in accord with the invention, the produced effect on interlacing points and looping of the individual filaments can be definitely influenced and thereby brought into desired form.

In the following, with the aid of FIGS. 3 to 15, a first embodiment of the jet nozzle arrangement is more closely explained, in which the cross-section of the opening of a single jet nozzle 37 is described. The FIGS. 3 to 15 show respectively a plane view of an embodiment example of the jet nozzle 37 as it vertically enters into the yarn conduit 13. The multifilament yarn (not shown) runs through the yarn conduit 13 in the direction of an arrow 27, thus corresponding to the presentation in the FIGS. 3 to 15, from right to left.

Figure 3:
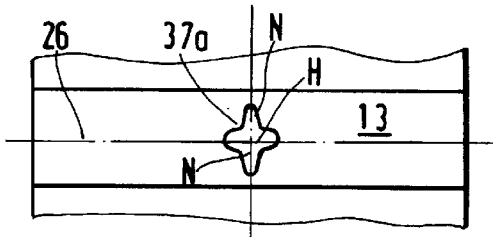
FIGS. 3 to 15 respectively, a plane view of a cross-section of the opening of a first embodiment variant of the jet nozzle arrangement in accord with the invention, wherein the main flow and side flows are produced by the shape of the cross-section of a jet nozzle.

FIG. 3 shows a jet nozzle 37*a*, the cross-section of the opening of which is designed symmetrically to the longitudinal center axis 26 of the yarn conduit 13 and to a cross axis 41, which makes a right angle (90°) with the said axis 26.

The intersection point of the longitudinal central axis 26 and the cross-axis 41 that lies orthogonally thereto, lies about in the center of the yarn conduit 13 when seen at right angles to the longitudinal extension of the yarn conduit 13. This is also in accord with another embodiment which is not shown. In connection with this present invention, if statements as to symmetry are made regarding a cross-section of a jet nozzle opening arrangement, then the basis thereof must be on a vertical view direction down onto the respective cross-section of the jet nozzle opening, that is, the viewing line coincides with the longitudinal axis of the jet nozzle 37 which opens into the yarn conduit 13. Thus, a symmetry statement is only valid in the case of a plane view of the cross-section of the opening of the jet nozzle. The cross-section of the opening of the jet nozzle 37*a* is designed to be shaped as a cross. The one figurative arm of the cross lies along the central longitudinal axis and the other figurative arm on the cross axis 41. The intersection of the figurative cross arms is rounded off in such a way that the part of the cross-section of the opening that extends itself into the peripheral zones 33 of the yarn conduit 13 of the jet nozzle 37*a* is smaller than the part of the cross-section of the opening in the central zone 29 of the jet nozzle 37*a*.

Looking across the running direction of the multifilament yarn, because of the differently sized parts of the cross-section of the opening, the medium flow entering the yarn conduit through the cross-section of the opening of said yarn conduit subdivides itself into the main flow H and the pair of side flows N.

As is obvious from FIG. 3, the main flow defines the central zone. The cross-sections for the main flow H are so chosen, that the main flow always carries a greater volume flow of the medium in comparison to each of the side flows N. As mentioned above and as shown in detail in FIG. 23, the main flow H impacts against the under side of the top 25 which forms the inner top side of the yarn conduit 13. When this happens, two parts of the flow become vortices, which entwine the filaments of the multifilament yarn.

The side flows N, entering into the peripheral zone 33 of the yarn conduit 13, take care that the filaments, migrating into the peripheral zone because of the vortexing, are returned as quickly as possible to the central zone 29. In this way, there has been brought about a minimizing of the dwell time in which the filaments find themselves in the peripheral zone in which practically no entwining occurs. An excellent entwining result is achieved, since the number of the unentwined, open yarn places has been reduced and the lengths of the faulty locations are shortened.

Figure 4:
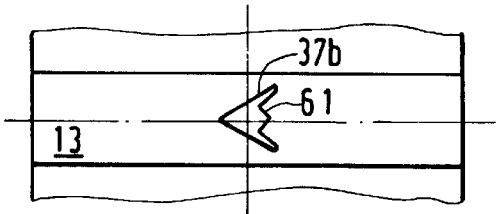

FIG. 4 shows a jet nozzle 37*b*, the cross-section of the opening of which is basically V-shaped, whereby, between the arms of the V, a reinforcement 61 of the main flow H is provided. By means of this reinforcement, the V-shape is generally changed to somewhat of a "W" shape, which together with a triangle forms the cross-section of the opening. The arms of the V-shape, i.e. the "W" shape, extend also in this case into the peripheral zone 33 of the yarn conduit.

Figure 5:
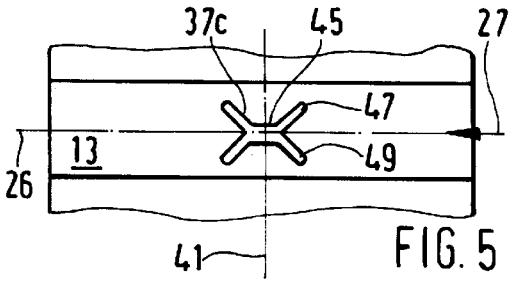

FIG. 5 presents a jet nozzle 37*c*, which exhibits again a cross shaped or better an elongated X-shaped, cross-section of the opening. The X shape, lying along the longitudinal axis of the conduit, possesses, along that said axis 26 of the conduit 13, a central flow 45 which carries the main flow H and is broader than the cross-arms 47 and 49. These cross arms extend into the peripheral zone 33 and carry the side flow N. The jet nozzle 37*c* is designed as symmetric to the longitudinal central axis 26 and to the cross axis 41. The side flows issuing from the cross-arms 47 and 49 of the X-shaped cross-section of the opening carry respectively a smaller volume flow than that in the central zone of the cross-section of the opening. That is, the volume is less than the flow from the central partial cross-section of the opening flow 45 designed for the main flow. By means of the arrow 27, the running direction of the thread through the thread canal becomes evident. From this, the situation is such that the side flows issuing from the ends of the cross-arms 47 and 49 precede the main flow. At the same time, the ends of the cross-arms 47' and 49' which are arranged in mirror image to the cross axis 41 yield a lagging pair of flows.

By means of this arrangement, a very good return transport of the filaments from the peripheral zones 33 is achieved, accompanied by a minimum disturbance of the main flow, which brings about an exceptionally good and uniform quality of the interlacing nodes.

Figure 6:
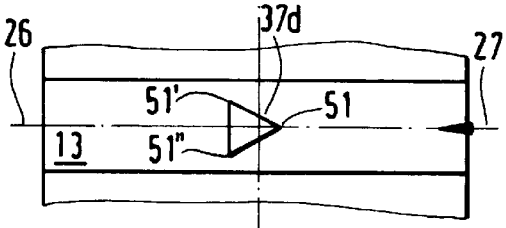

The jet nozzle 37*d* depicted in FIG. 6 exhibits an equilateral triangular, cross-sectional opening and is so installed in the yarn conduit 13 that an apex 51, formed by two sides of the equilateral triangle, lies on the longitudinal central axis 26 of the yarn conduit 13. The jet nozzle 37*d* is designed to be symmetric to the longitudinal central axis 26. The multifilament yarn led through the yarn conduit in the direction of arrow 27 first contacts the entering main flow H in the area of the apex 51 of the cross-section of the opening. The main flow H becomes increasingly greater and is subsequently impacted by the side flows N, which issue from the areas 51' and 51" of the triangular cross-section of the opening. In this case, experience has shown that a higher interlacing frequency is realizable, when the side flows N extend further into the peripheral zone 33 of the yarn conduit 13. The higher interlacing situation arises, because the interlacing points occur at shorter spatial intervals than those produced by a jet nozzle with the cross-section of the opening of the side flows N extending less into the peripheral zone.

The jet nozzle shown in FIG. 7, again depicts a cross-sectional opening in the shape of an equilateral triangle, wherein the apex 53 thereof, which lies on the longitudinal central axis 26 and is formed by two sides, trails the main flow issuing out of the central area of the cross-section of the opening of the jet nozzle 37*e* as seen in the running direction of the multifilament yarn (arrow 27). The multifilament yarn is also first carried over the base of said equilateral triangle. Thereby, contrary to the arrangement of the depicted jet nozzle 37*d* of FIG. 6, a more intensive and more uniform interlacing of the filaments with long spaced interlacing nodes is achieved. Also, the cross-section of the opening of the jet nozzle 37*e* is designed symmetric to the longitudinal central axis 26 (which is true in all other embodiment examples of a jet nozzle in accord with the invention).

Figure 7:
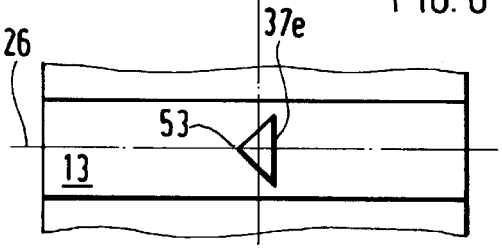
Figure 8:
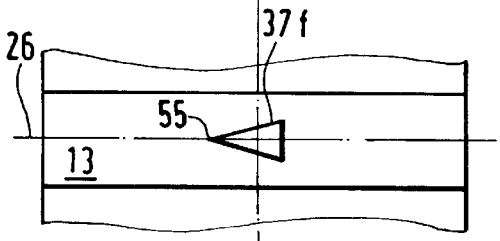

FIG. 8 shows a jet nozzle 37*f*, which exhibits a cross-section in the shape of an isosceles triangle, wherein the triangle has two equal sides and, contrary to the triangles of FIGS. 6 and 7, is very narrow. Because of this arrangement of the jet nozzle, the central part of the cross-section of the opening of the jet nozzle 37*f* is very unusual, in particular when compared with those with side zones, which intrude into the peripheral areas of the cross-section of the opening. From this arrangement, there arises a stronger main flow as opposed to the pair of side flows. The apex 55, formed from the equal sides of this isosceles triangle, lies on the longitudinal central axis 26 in such a way that the multifilament yarn carried through the yarn conduit 13 is first picked up by the main flow. However, simultaneously the pair of side flows becomes active, which flow into the peripheral zone 33 of the yarn conduit from the area of the base of the triangularly shaped partial cross-section of the opening 13.

Figure 9:
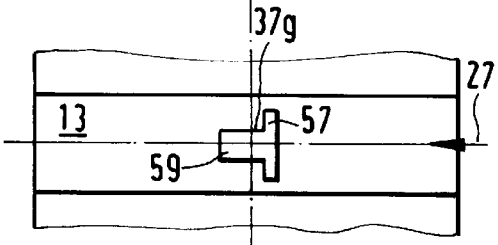

FIG. 9 demonstrates a jet nozzle 37*g* with a T shaped cross-section of the opening., wherein the top cross arm 57 of the T-shaped designed partial cross-section opening precedes that partial cross-section opening formed from the stem of the T as seen in the running direction of the multifilament yarn (arrow 27). The cross arm 57, which is narrower than the stem 59 of the T, reaches into the peripheral zone 33 of the yarn conduit 13. The incoming multifilament yarn first reaches the top of the T shaped cross-sectional opening in which both main flow and side flows are effective. This arrangement creates a more uniform entwining, since simultaneously, by means of the side flow pair, a migration of the multifilament yarn into the dead zone 33 is prevented.

Figure 10:
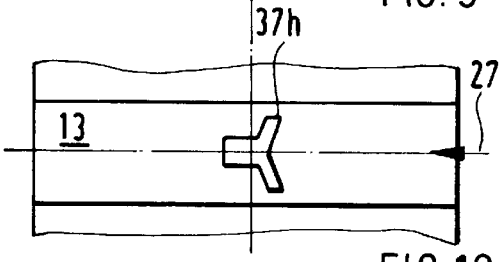

FIG. 10 shows a jet nozzle 37*h*, the opening of which is in the shape of a Y, whereby the essentially V-shaped part of the Y-shape, precedes that cross-section portion formed from the lower stem of the Y as seen in the running direction of the multifilament yarn (arrow 27). The upper ends of the V-shaped part of the Y design reach far into the peripheral zones 33 of the yarn conduit 13. Thereby, the filaments of the multifilament yarn conducted through the yarn conduit 13 are first seized by the side flows emitted from the V-shaped portion of the cross-section of the opening of the jet nozzle 37*h* and returned to the middle area 29 of the yarn conduit 13. Subsequently, the filaments are picked up by the main flow which is issuing out of the stem of the Y-shaped designed partial cross-sectional opening of the jet nozzle 37*h* and thereby entwined. By means of this Y-design, of the cross-section of the opening, the main flow is less disturbed by the side flows and thus said main flow becomes immediately effective, as is the case with the jet nozzle 37*h*.

Figure 11:
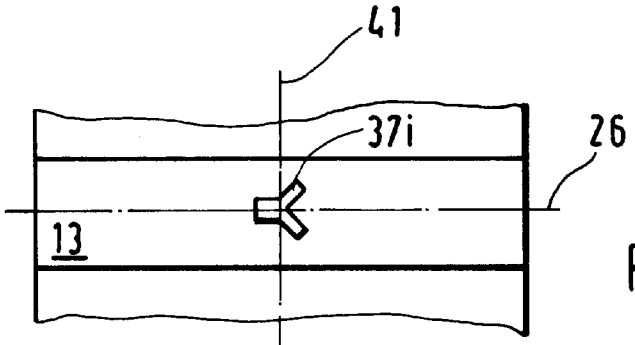

In the embodiment shown in FIG. 11, the jet nozzle 37*i* differentiates itself from the jet nozzle presented in FIG. 10 principally therein, in that the Y-shape of the cross-section of the opening has been altered. The two arms which together form the V-shape of the Y combine in a more acute angle, so that these arms do not extend themselves so far into the peripheral zone 33 of the yarn conduit 13 as do the arms of the Y-shaped cross-section of the opening as shown in FIG. 10.

Figure 12:
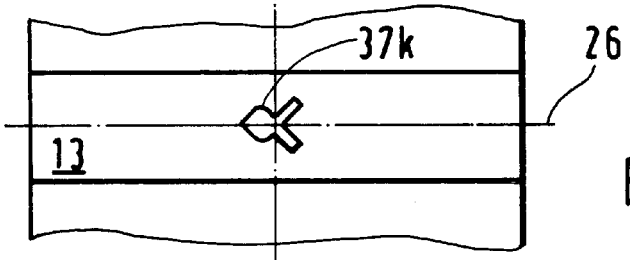

FIG. 12 presents a jet nozzle 37*k* which possesses a cross-section of the opening which has evolved from the Y-shape. The stem of the Y, which coincides with the longitudinal central axis 26, is broader in comparison to the Y-shape shown in FIGS. 10, 11. Further, the free ends of the stem is constructed relatively short and wedge-shaped.

Figure 13:
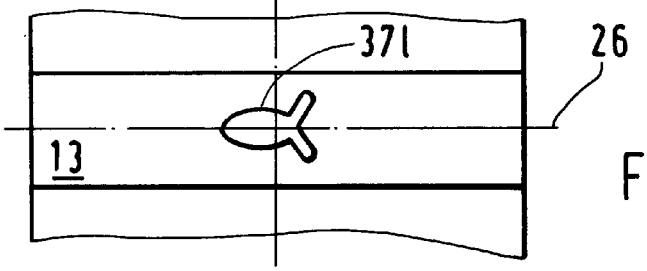

FIG. 13 presents a fish shaped jet nozzle 37*l* that cross-sectional opening is derived from an ellipse and two arms which form a V-shape. The two arms reach into the peripheral zone 33 of the yarn conduit 13, while the ellipse lies with its major semi-axis along the longitudinal central axis 26 of the yarn conduit 13, and thus forms the main flow.

Figure 14:
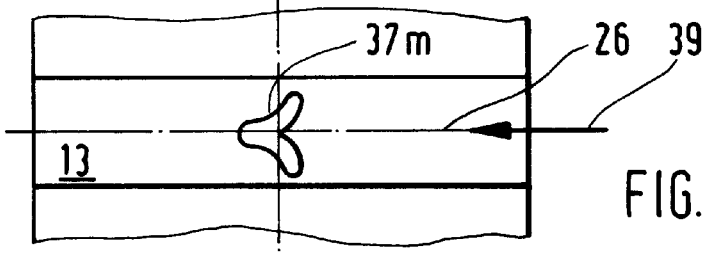

FIG. 14, shows a jet nozzle 37*m*, which cross-sectional opening exhibits a V-shape with outwardly curved arms. In other words, the arms of the V-shape are not straight, are bowed away from the central axis.

Furthermore, all sharp corners of the cross-section of the opening of the jet nozzle 37*m* have been rounded off or are in accord with a further, not shown, radius. The cross-section of the opening is expanded in the central area 29 of the yarn conduit 13. Since in this embodiment the said curved arms extend deeply into the peripheral zone, the filaments are quickly conveyed out of this dead zone.

Figure 15:
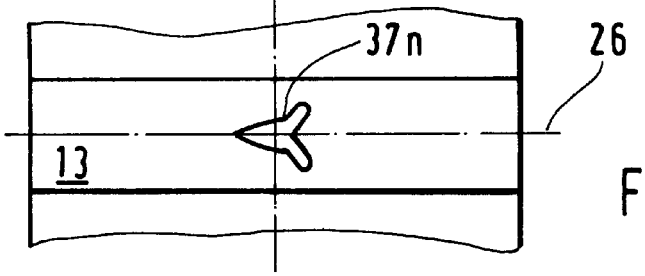

The jet nozzle shown in FIG. 15, this being nozzle 37*n*, exhibits what is essentially a cross-section of the opening shape derived from a triangle in which the two arms which form a V-shape with one another. These arms reach into the peripheral zone 33 of the yarn conduit 13.

FIGS. 16 to 19 show, respectively, a plane view of the cross-section of the opening of an additional embodiment variant, with a jet nozzle arrangement 35, in which are designed cross-sectional openings for several, in this case a total of three, jet nozzles, designated 37/1, 37/2 and 37/3 respectively. These embodiments have openings spatially distanced, one from another in the yarn conduit 13 and each shows a partial cross-section of the opening, which together form the cross-section of the opening of the jet nozzle arrangement 35. The partial cross-section of the opening of the jet nozzle 37/1 from which the main flow of the medium emerges into the yarn conduit 13 is in any case greater than those of the jet nozzles 37/2 and 37/3 out of which the side flows are injected. The cross-sections of the opening of the nozzles in all embodiments is independent of the number of the jet nozzles and the jet nozzle arrangement is designed symmetrical to the longitudinal axis 26 of the yarn conduit 13, as seen from a view point in the direction of the axis of the jet nozzles which open into the yarn conduit.

Figure 16:
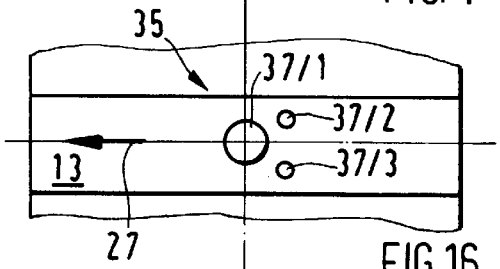
FIGS. 16 to 19 respectively, a plane view of a cross-section of the opening to of a second embodiment variant of the jet nozzle arrangement, in which the main and side flows are physically separated.

The partial cross-section of the opening which appears in FIG. 16, features jet nozzles 37/1 to 37/3 which are circular in shape. The central location of the jet nozzle 37/1 out of which the main flow of the medium emerges lies at the intersection point between the longitudinal central axis 26 and the cross axis 41. As seen in the running of the multifilament yarn (arrow 27), the jet nozzles 37/2 and 37/3 through which, respectively, a side flow enters into the yarn conduit 13 are located before the said jet nozzle 37/1. These jet nozzles 37/2 and 37/3 lie respectively in the peripheral zone 33 of the yarn conduit 13.

Figure 17:
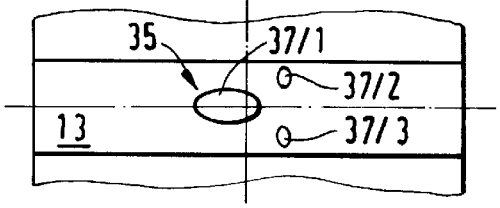

The embodiment shown in FIG. 17 of the jet nozzle arrangement differentiates itself from the presented embodiment of FIG. 16 principally in that the partial cross-section of the openings of the jet nozzles 37/1 to 37/3 are designed in the shape of an ellipse. The major semi-axis of the ellipse that forms the partial cross-section of the opening 37/1 lies upon the longitudinal central axis 26. The major semi-axes of the respectively smaller elliptical, partial cross-sectional openings of the jet nozzles 37/2 and 37/3 lie at right angles to said longitudinal central axis 26 and oppositely to the partial cross-section of the opening 37/1.

Figure 18:
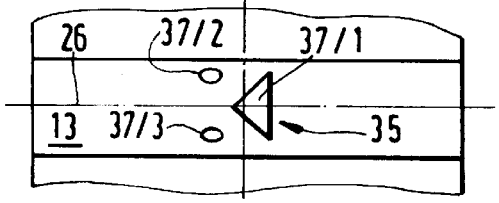

In FIG. 18, we see an embodiment of the jet nozzle arrangement 35 in which the cross-section of the opening is formed from a triangular and two ellipse shaped partial cross-sectional openings. As seen in the running direction of the multifilament yarn (arrow 27), the jet nozzle 37/1, which exhibits a triangular partial cross-sectional opening, precedes over the jet nozzles 37/2 and 37/3 in such a way that one side of the partial cross-section of the opening is parallel to the cross axis 41. The multifilament yarn carried in the yarn conduit 13 is first brought over this said one side, so that simultaneously, the main flow and the side flows become effective.

Figure 19:
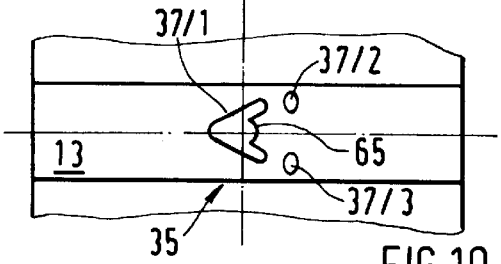

The embodiment shown in FIG. 19 of the jet nozzle arrangement 35 encompasses two jet nozzles 37/2 and 37/3, the partial cross-sectional area of each being elliptic in shape, and one jet nozzle 37/1, the partial cross-section of the opening of which exhibits a V shape with a central expansion 65. This increases the partial cross-section of the opening. The jet nozzles 37/2 and 37/3 from which, respectively, a side flow of the medium emerges into the yarn conduit 13 precede the jet nozzle 37/1 as seen in the running direction of the multifilament yarn, so that the side flow pair initiates the activity. Since the jet nozzle 37/1 with its partial cross-section of the opening extends into the peripheral zone 33 of the yarn conduit 13, the situation is as if once again two side flows enter along with the main flow. The partial cross-section of the opening of the jet nozzles 37/1, 37/2 and 37/3 form in common the cross-section of the opening of the jet nozzle opening arrangement 35, wherein the symmetry to the longitudinal central axis 26 of the yarn conduit 13 remains intact.

In all the descriptions of the jet nozzle arrangement 35 made with the aid of FIGS. 3 to 19, the cross-section of the opening of which is presented with sharp corners, i.e. edges, these corners exhibit a rounding off radius, which lies in a range of 0.03 mm to 0.20 mm because of current technical manufacturing reasons.

In a close consideration of FIGS. 16, 17 and 19, it becomes clear that the jet nozzles from which the side flows of the medium enter into the yarn conduit 13 advantageously precede the jet nozzle from which the main flow of the medium enters the yarn conduit 13. That is, the filaments of the multifilament yarn are first interacted with the side flows in the peripheral zone 33 of the yarn conduit, and then subsequently are entwined by the main flow which enters into the central zone 29 of the yarn conduit 13. In the case of the embodiment in accord with FIG. 18, the filaments are seized by the main flow, but simultaneously also by the side flows. The back-setting of the side flow pair of the jet nozzles 37/2 and 37/3 reinforces the effect of the side flow action, without interfering with the main flow.

Among other effects, experience has shown, that preferentially, a good interlacing result is achieved with minimum air consumption, when the main and side flows in reference to placement do not act simultaneously.

Particularly good results were obtained for all kinds of yarns with the construction in accord with FIG. 20 or even FIG. 21. The FIG. 20 shows a plane view of an embodiment of the jet nozzle arrangement 35 in which the cross-section of the opening of a jet nozzle 37*o* is symmetrical to the longitudinal central axis 26. The cross-section of the opening of the jet nozzle 37*o* is composed of two figurative partial cross-sections of the openings, which, in this case, are run together.

The first partial cross-section of the opening is essentially C-shaped and extends itself entirely to the edges of the yarn conduit 13. The elliptic second partial cross-sectional opening follows this first partial cross-section of the opening, again seen in the running direction of the multifilament yarn (arrow 27). The main flow of the medium emerges solely from said elliptic opening into the yarn conduit 13.

In the connection area between the partial cross-section of the openings of the jet nozzle 37*o*, which lies in the area of the intersection of longitudinal axis 26 and the cross axis 41, the breadth of the opening cross section is less than that of the forward rear cross-sections. In accord with a preferential embodiment variant, this configuration causes the main medium flow to be divided into two main partial flows, which act on the multifilament yarn both positionally and chronologically one after another. In accord with a further (not shown) embodiment variant, the main flow of the medium is divided in more than two, even into three main partial flows. The "division" is not to be understood as physical, but is brought about especially by means of the shaping of the cross-section of the opening, such as has been realized in the embodiment presented in FIG. 20.

The filaments in the yarn conduit, which are in the peripheral zone 33 thereof, are first impelled into the central area 29 of said yarn conduit by the side flows from the C-shaped partial cross-section of the opening of the jet nozzle 37*o*. These filaments now are seized by the first main flow of the medium and are entwined. By this means, a desirable structuring becomes possible of the filaments, i.e. the multifilament yarn.

FIG. 21 shows another embodiment variant of the jet nozzle arrangement presented in FIG. 20 in which the cross-section of the opening of two jet nozzles 37/1 and 37/2 is designed. The partial cross-section of the opening of the jet nozzle 37/1 has a circular shape from which the main flow of the medium emerges, into the yarn conduit 13. The generally C-shaped jet nozzle 37/2 directly precedes the jet nozzle 37/1 and extends itself into the peripheral zone 33 of the yarn conduit 13. The two main flows are physically separated from one another, that is, the first main flow in combination with the side flows, and the second main flow are blown into the yarn conduit 13 by two jet nozzles separated from one another. Contrary to this arrangement, as presented in the jet nozzle 37*o* of FIG. 20, the main flow and the side flows are expelled in common out of one jet nozzle into the yarn conduit 13. Upon considering the FIGS. 20 and 21, it becomes clear that the cross-section of the openings of the two jet nozzle arrangement 35 are very similar to one another. Consequently, very similar action is obtained from each.

FIG. 22 presents a sectional view of an embodiment of the yarn conduit 13 through which a multifilament yarn 69 is carried; the yarn being depicted by dotted lines. Into the yarn conduit, opens a jet nozzle 37, the cross section of which is variable and, for instance, can be designed in accord with the above mentioned presentations of cross-section of the openings in FIGS. 3 to 21. The jet nozzle 37 is inclined against the longitudinal central axis 26 of the yarn conduit 13 at an angle δ, which is measured between the axis 71 of the jet nozzle 37 and the longitudinal central axis 26 of the yarn conduit 13.

In accord with an additional embodiment variant the jet nozzle 37 is inclined against the longitudinal central axis 26 by an angle δ, which measures in a range of $60° \leqq \delta \leqq 90°$, preferably in a range of $75° \leqq \delta \leqq 87°$. It has become evident that by the specified inclination of the jet nozzle 37 the entwining results can be additionally influenced. By the embodiment examples shown in the above discussed FIGS. 3 to 21, the jet nozzle arrangement 35 carries an angle δ of inclination as described above of basically 90°. In order to produce an optical change that is a structuring of the multifilament yarn, it has shown itself as particularly advantageous to choose the angle $\delta \leqq 60°$. Thus, for instance, loops and other structuring of the filaments can be produced in an optional manner. The present invention can also be employed favorably. for the texturing of filament yarns, where in the texturing of yarns, an improved interlacing result is attainable as compared to results where the inclination of the jet nozzle is contrary to the running direction of the multifilament yarn.

However, results with a jet nozzle inclined against the running direction of the multifilament yarn suffice in many cases for given requirements, so that fundamentally, the inclination of the jet nozzle 37 is practically an optional matter of choice.

In the case of a jet nozzle arrangement 35 in which a plurality of jet nozzles are involved, as described with the aid of FIGS. 16 to 19 and FIGS. 20, 21, the jet nozzles 37/1, 37/2 and 37/3 each can be differently inclined against the longitudinal central axis 26 of the yarn conduit, and also show different angles of inclination.

The main flow and the side flows act in these cases in directions varying from one another, which makes possible an optimized adjustment of the effective operation of the partial flows of the medium.

In FIG. 23, the effective action of the main flow H and the side flows N of the medium entering the yarn conduit 13 is presented with the aid of a schematic cross-section of an interlacing apparatus. In the depicted embodiment shown here, the main and side flows are not physically separated from one another. Obviously, the functional presentation may be transferred easily to physically separated main and side flows.

The jet nozzle opens at the base of the semi-circular shaped yarn conduit 13 in the central area into which the main flow of the medium, indicated with an arrow H, enters and upon impacting on the top plate 25, divides itself into two partial flow vortices, which show opposite rotation directions. By means of these vortices, the filaments of the multifilament yarn are intensively entwined, so that strong interlacing points, i.e. interlacing nodes, are formed. In any case, as this flow, vortices, or yarn proceeds, the filaments are also accelerated into the peripheral zone 33 of the yarn conduit 13, which forms a dead space where no interlacing occurs. By means of the side flows N entering the peripheral zone 33, which flows enter approximately concurrently with the main flow H into the yarn conduit 13, the filaments are seized by these side flows and brought back into the central zone 29 of the yarn conduit 13. They dwell only for a short time in said dead space of the peripheral zone 33 and are immediately placed again in the main air flow, where the interlacing occurs. As may be inferred from the right half of the FIG. 23 about the side flow N, only a portion of the peripheral zone 33 of the yarn conduit is reached by means of the cross-section of the opening. The interaction varies in accord with how far the peripheral zone 33 is penetrated by the air flow N. In the FIGS. 3 to 21, as an example, the opening in the peripheral zone 33 is shown corresponding to the right half of the FIG. 23. Obviously, the peripheral zone 33 penetrated by the side flows can extend itself beyond the yarn conduit 13, going on beneath the top cover 25.

By means of this variation, the interlacing in regard to nodes, number and thickness as well as frequency of the same can be additionally influenced in a decisive way. For this reason, the FIGS. 3 to 21 are to be understood in connection with these variations, even when it is shown in the Figure that the cross-section of the opening ends at the side of the yarn conduit.

From the description of the FIGS. 1 to 23, a process comes into being for the handling of filament yarns, in order to entwine these yarns. This process includes the apportionment of the medium flow into one main flow and a pair of side flows, wherein the main flow is introduced into the central zone of the yarn conduit and one of the side flows into the one part of the peripheral zone and the other side flow into another part of the peripheral zone of the yarn conduit, so that the directions of the different air flows do not cross. In other words, the air flows may have different directions so long as they stay in the central and outer peripheral zones, respectively, without crossing. Main and side flows are guided in essentially the same direction. The main flow generally should carry the largest volume flow as compared to each of the side flows. By means of appropriate adjustment of the size of the side flows as compared to the main flow, the dwell time in which the filaments remain in the peripheral zones of the yarn conduit can be reduced, so that the results of the interlacing by said adjustment can be positively influenced. In this manner unentwined, open yarn places of a definite size also can be reduced. Also, the node number, the size and solidity of the same can be changed with a quantitative certainty. The breadth of the central area in which the actual interlacing takes place as well as the remaining peripheral zones in which no interlacing occurs are all defined by the main flow.

In summary, it can be maintained, that by means of the apportionment of the medium flow into a plurality of flows, the interlacing quality is improved. Advantageously accompanying the continued, satisfactory interlacing results, the medium consumption is reduced so that the costs of the interlacing can be reduced. By means of the effective coactivity of the side flows with the main flow of the medium, an increase in the speed of running for the multifilament yarn and concomitant thereto an improved productivity of the interlacing apparatus becomes possible.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. An apparatus for interlacing a multifilament yarn, said apparatus comprising:

a housing, said housing having a yarn conduit defined therethrough through which said multifilament yarn is transported;

a jet nozzle configured with said housing and defining a jet passage for a pressurized medium to flow therethrough into said yarn conduit, said jet nozzle further comprising a cross-sectional opening disposed generally transverse to and symmetrical relative to a longitudinal axis through said yarn conduit;

said cross-sectional opening of said jet nozzle comprising a main channel disposed symmetric to said yarn conduit longitudinal axis, and at least two side channels wherein said side channels are disposed a sufficient lateral distance from and on either side of said yarn conduit longitudinal axis such that said side channels direct the pressurized medium to opposite peripheral zones of said yarn conduit; and wherein said main channel and said side channels are disposed and oriented so as to direct the pressurized medium in generally the same direction into said yarn conduit, and wherein said main channel directs a greater volume of the pressurized medium into a central region of said yarn conduit where substantially all of the interlacing of the multifilaments takes place as compared to said side channels that each direct a lesser volume of the pressurized medium to said peripheral zones where substantially no interlacing of the multifilaments takes place.

2. An apparatus for interlacing a multifilament yarn as recited in claim 1, further comprising a pivotable swing arm connected to said housing, said swing arm forming a top of said yarn conduit for allowing said multifilament yarn to be placed in and removed from said yarn conduit without being severed.

3. An apparatus for interlacing a multifilament yarn as recited in claim 1, wherein a main flow from said main channel in comparison to side flows from said side channels carries the greatest volume flow of the pressurized medium.

4. An apparatus for interlacing a multifilament yarn as recited in claim 1, wherein said jet nozzle is inclined as compared to said longitudinal axis of said yarn conduit as seen in the running direction of the yarn at an angle of about 60° through 90°.

5. An apparatus for interlacing a multifilament yarn as recited in claim 1, wherein said jet nozzle is disposed such that its said cross-sectional opening is symmetrical to a cross axis that perpendicularly intersects said longitudinal axis of said yarn conduit.

6. An apparatus for interlacing a multifilament yarn as recited in claim 1, wherein said jet nozzle is disposed such that its said cross-sectional opening is asymmetrical to a cross axis that perpendicularly intersects said longitudinal axis of said yarn conduit.

7. An apparatus for interlacing a multifilament yarn as recited in claim 1, wherein said main channel is disposed after said side channels as seen in the running direction of the yarn.

8. An apparatus for interlacing a multifilament yarn as recited in claim 1, wherein said main channel is disposed before said side channels as seen in the running direction of the yarn.

9. An apparatus for interlacing a multifilament yarn as recited in claim 1, wherein said main channel is spatially separated from the side channels.

10. An apparatus for interlacing a multifilament yarn as recited in claim 1, wherein said cross-section of said jet nozzle opening is a Y-shape.

11. An apparatus for interlacing a multifilament yarn as recited in claim 1, wherein said cross-section of said jet nozzle opening is a cross shape.

12. An apparatus for interlacing a multifilament yarn as recited in claim 1, wherein said cross-section of said jet nozzle opening is a triangle shape.

13. An apparatus for interlacing a multifilament yarn as recited in claim 1, wherein said cross-section of said jet nozzle opening is a T-shape.

14. An apparatus for interlacing a multifilament yarn as recited in claim 1, wherein said cross-section of said jet nozzle opening is an X-shape.

15. An apparatus for interlacing a multifilament yarn as recited in claim 1, wherein said main channel is formed from a plurality of partial flows.

16. An apparatus for interlacing a multifilament yarn, said apparatus comprising:

a housing defining a base of a yarn conduit through which said multifilament yarn can be transported, and a top for said yarn conduit;

a jet nozzle in communication with said yarn conduit, said jet nozzle further comprising a cross-sectional opening that is disposed generally symmetrical relative to a longitudinal axis through said yarn conduit and is inclined with respect to said longitudinal axis of said yarn conduit at an angle of about 60° through 90°;

said cross-sectional opening of said jet nozzle comprises a main channel disposed symmetric to said yarn conduit longitudinal axis creating a main flow of a pressurized medium in a central region of said yarn conduit wherein substantially all of the interlacing of the multifilaments takes place, and at least two side channels wherein one said side channel is laterally displaced on either side of said yarn conduit longitudinal axis such that said side channels direct the pressurized medium to opposite peripheral zones of said yarn conduit on either side of said middle zone where substantially no interlacing of the multifilaments takes place, creating side flows on either side of said main flow; and wherein said main flow carries a greater volume of the pressurized medium as compared to each of said side flows, and said main and said side flows are directed in generally the same direction into and through said yarn conduit.

17. An apparatus for interlacing a multifilament yarn as recited in claim 16, wherein said main channel is disposed after said side channels as seen in the running direction of the yarn.

18. An apparatus for interlacing a multifilament yarn as recited in claim 16, wherein said main channel is disposed before said side channels as seen in the running direction of the yarn.

19. An apparatus for interlacing a multifilament yarn as recited in claim 16, wherein said main channel is spatially separated from the side channels.

20. An apparatus for interlacing a multifilament yarn as recited in claim 16, wherein said main channel is formed from a plurality of partial flows.

21. A process for interlacing multifilament yarn in a yarn conduit by directing a pressurized medium into the yarn conduit, said process comprising the steps of:

directing the pressurized medium into the yarn conduit from a direction transverse to a longitudinal axis through the yarn conduit;

separating the pressurized medium flow into a main flow that is symmetrical relative to the longitudinal axis of the yarn conduit and directing the main flow to a central region of the yarn conduit where substantially all of the interlacing of the multifilaments takes place, and a pair of side flows that are laterally displaced from the longitudinal axis of the yarn conduit and directing each of the side flows to opposite peripheral zones in the yarn conduit on either side of the longitudinal axis of the yarn conduit where substantially no interlacing of the multifilaments takes place; and directing the pressurized medium from the main flow and side flows into yarn conduit in the same general direction.

22. A process for interlacing multifilament yarn as recited in claim 21, further comprising passing the yarn through the yarn conduit along the longitudinal axis of the yarn conduit.

23. A process for interlacing multifilament yarn as recited in claim 21, wherein the main flow carries a larger volume of the medium than the side flows.

24. A process for interlacing multifilament yarn as recited in claim 22, further comprising minimizing dwell time of a filament in the peripheral zones with the side flows that propel filaments back into the middle zone where the main flow causes entwining to occur.

25. A process for interlacing multifilament yarn as recited in claim 21, further compromising introducing the main flow after the side flows in a running direction of the yarn through the yarn conduit.

26. A process for interlacing multifilament yarn as recited in claim 21, further compromising introducing the main flow before the side flows in a running direction of the yarn through the yarn conduit.

27. A process for interlacing multifilament yarn as recited in claim 21, further comprising spatially separating the main flow from said side flows.

* * * * *